US007938068B2

(12) United States Patent
Parker et al.

(10) Patent No.: US 7,938,068 B2
(45) Date of Patent: May 10, 2011

(54) TOY TRACK SECTION WITH ALIGNMENT FEATURE

(75) Inventors: Kenneth G. Parker, Williamsville, NY (US); Ray C. Phinney, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 108 days.

(21) Appl. No.: 12/200,489

(22) Filed: Aug. 28, 2008

(65) Prior Publication Data

US 2010/0056020 A1 Mar. 4, 2010

(51) Int. Cl.
*A63G 1/00* (2006.01)

(52) U.S. Cl. ..... 104/53; 238/10 R; 238/10 E; 446/444

(58) Field of Classification Search ..... 104/53; 238/10 R, 10 E, 10 F; 446/444
See application file for complete search history.

(56) References Cited

U.S. PATENT DOCUMENTS

| | | | | |
|---|---|---|---|---|
| 2,068,403 | A | | 1/1937 | Ekstrom |
| 2,383,940 | A | | 9/1945 | Minner |
| 2,493,010 | A | | 1/1950 | McDonald |
| 2,590,317 | A | | 3/1952 | Henderson |
| 3,074,647 | A | | 1/1963 | Bonanno |
| 3,218,757 | A | | 11/1965 | Benkoe |
| 3,442,047 | A | | 5/1969 | Quigley et al. |
| 3,514,895 | A | * | 6/1970 | Olson et al. ..... 446/428 |
| 3,610,525 | A | | 10/1971 | Townsend et al. |
| 3,628,725 | A | * | 12/1971 | Edwards et al. ..... 235/29 R |
| 3,643,865 | A | | 2/1972 | Mutz et al. |
| D258,225 | S | | 2/1981 | Rawson |
| 4,355,807 | A | | 10/1982 | Prehodka |
| 4,395,843 | A | | 8/1983 | Fichter et al. |
| 4,493,265 | A | * | 1/1985 | Miura ..... 104/269 |
| 4,496,100 | A | * | 1/1985 | Schwager et al. ..... 238/10 R |
| RE32,106 | E | | 4/1986 | Lemelson |
| 4,585,166 | A | | 4/1986 | Stephens |
| 4,715,843 | A | | 12/1987 | Ostendorff et al. |
| D344,310 | S | | 2/1994 | Ruszkai |
| 5,297,484 | A | * | 3/1994 | Piserchia et al. ..... 105/1.5 |
| 5,791,253 | A | * | 8/1998 | Schultheis et al. ..... 104/53 |
| 6,601,774 | B1 | * | 8/2003 | Kasimoff ..... 238/10 R |
| 7,051,948 | B2 | * | 5/2006 | Wa ..... 238/10 E |
| 7,302,894 | B2 | | 12/2007 | Belanger et al. |
| 7,517,272 | B2 | * | 4/2009 | Bedford et al. ..... 446/444 |
| 2007/0259600 | A1 | * | 11/2007 | Bedford et al. ..... 446/444 |
| 2008/0105156 | A1 | * | 5/2008 | Olsen ..... 104/264 |

FOREIGN PATENT DOCUMENTS

| | | |
|---|---|---|
| EP | 097731 | 1/1984 |

* cited by examiner

*Primary Examiner* — S. Joseph Morano
*Assistant Examiner* — Jason C Smith
(74) *Attorney, Agent, or Firm* — Edell, Shapiro & Finnan LLC

(57) ABSTRACT

The present invention relates to section of track that can be used with a toy train track set that has a toy vehicle and a track. The section of track is configured to align a toy train that is placed on the track section. The alignment section of track includes guide surfaces that are configured to align the toy train on the track.

21 Claims, 12 Drawing Sheets

TOY TRACK SECTION WITH ALIGNMENT FEATURE

FIELD OF THE INVENTION

The present invention relates to a track section for a toy train track. In particular, the present invention relates to a track section that is configured to align a train that is placed on the track section.

BACKGROUND OF THE INVENTION

A train set is a common children's toy. A train set generally includes a track and one or more toy trains or cars that can travel or be moved by a child along the track. Some toy trains have wheels on each side of a train body that are designed to contact and roll along surfaces, such as rails, on the track.

The placement of wheels on rails results in trains being difficult to place on the track for children. For example, the wheels on the toy train can be difficult to align with the rails on the track. Many toy train cars include two axles, such as a front axle and a rear axle, with two wheels coupled to each axle. Each set of wheels is required to be precisely positioned on the track to achieve proper alignment. When a toy train is placed on a track in a misaligned manner, the train is usually unable to run or be moved along the track. In addition, a toy train may include several cars. If even one of the wheels on one of the cars is improperly positioned on the track, the toy train as a whole will not travel along the track properly.

Young children sometimes find it difficult and frustrating to realign toy trains on a track. Furthermore, it is fairly common for play with toy train sets to involve frequent toy train derailments and the need for realignments. There is therefore a need to develop a system for easily placing a toy train in alignment on a track. Specifically, there is a need to develop a track section that accommodates a train thereon such that positioning the train on a portion of the track section will result in proper alignment of the train on the track.

SUMMARY OF THE INVENTION

An alignment section or portion of a track of a toy train set is disclosed in the embodiments of the present invention. The toy train set includes a train and a track that can be supported by a play surface. In one embodiment, the train track includes multiple sections along which a train can travel. The track includes an alignment or guide section that has a guide portion. The guide portion is the portion of the alignment section that directly contacts or is engaged by the train and that is configured to align the train.

In one embodiment, the guide portion of the track includes first and second wheel bearing surfaces for supporting at least a portion of the weight of the train. The guide portion also includes first and second guide surfaces. In one embodiment, the guide surfaces can be located between the bearing surfaces. In one implementation, the first and second guide surfaces are disposed or orientated in an inclined manner. In addition, the guide portion can include an engagement surface or portion for receiving or engaging with a propulsion or drive member of a train. In one embodiment, the engagement surface is located between the first and second guide surfaces.

In different embodiments, the trains can have one car, such as an engine, or can have two or more cars. Each car has multiple sets of wheels and each set of wheels includes two wheels that are connected to each other by a transverse axle. Typically, a car includes a front wheel set and a rear wheel set, with each of the front and rear wheel sets including a wheel on opposite sides of the body of the cars of the train.

In accordance with the invention, a train that is placed on the guide portion of the alignment section is automatically aligned for travel along the remainder of the track. Initially, a train that has been separated from the track is placed so that its wheels contact a portion of the guide surfaces of the track section. The guide surfaces are inclined or angled, and the weight of the train and/or the forward motion of the train cause the wheels of the train to travel downwardly and outwardly along the particular inclined guide surface. Each of the wheels of the train travels outwardly until it reaches the lower edge of the guide surface and engages with the corresponding bearing surface.

In one embodiment, wheel sets are sized and configured relative to the track so that when the left wheels of a train car are at the lower edge of a guide surface on the left side, the right wheels are at the lower edge of a guide surface on the right side. Once aligned, the train wheels roll along the lower edges of the inclined surfaces and on the wheel bearing surfaces. As a result, the inclined surface of each of the first and second guide surfaces urge a wheel outwardly if it moves inwardly against and engages the guide surface. Therefore, after alignment, the wheels tend to remain properly aligned as the train travels along the wheel bearing surfaces.

BRIEF DESCRIPTION OF THE DRAWINGS

Like reference numerals have been used to identify like elements throughout this disclosure.

DETAILED DESCRIPTION OF THE INVENTION

Figure 1:
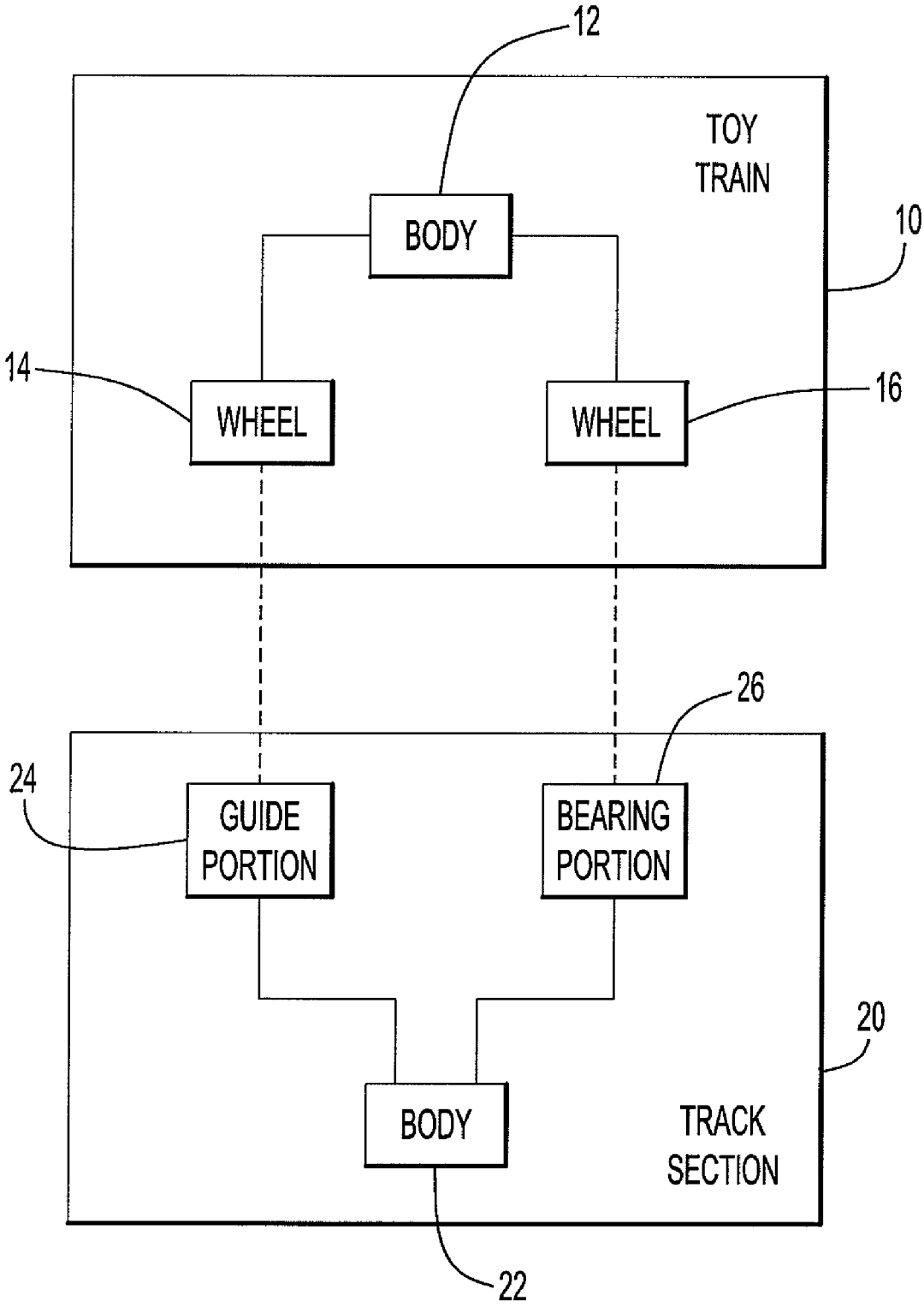
FIG. 1 illustrates a schematic block diagram of an embodiment of a toy train and track section in accordance with an aspect of the present invention.

Referring to FIG. 1, a schematic block diagram of an embodiment of a toy train and a track section in accordance with the present invention is illustrated. In this embodiment, the toy train 10 includes a body or body portion 12 with wheels 14 and 16 movably coupled to the body 12. The body 12 can be configured so that it resembles the body of a toy train. In one implementation, the wheels 14 and 16 can be left side and right side wheels, respectively, that are coupled to an axle that is rotatably mounted to the body 12. It is to be understood that the toy train 10 may include two additional wheels, which are not illustrated for ease of reference.

The track section is configured to align toy train 10 so that it can travel along a toy track. The track section 20 includes a body or body portion 22 that has a guide portion 24 and a bearing portion 26. The guide portion 24 and the bearing portion 26 are formed on the body 22 and may be different surfaces. In one embodiment, the track section 20 is a molded plastic article with the guide portion 24 and the bearing portion 26 formed thereon. Alternatively, the guide portion 24 and/or the bearing portion 26 can be formed separately from the body 22 and subsequently coupled thereto.

As reflected by the dashed lines in FIG. 1, the toy train 10 can be moved proximate to the track section 20 so that wheels 14 and 16 engage the track section 20. In particular, either or both of the wheels 14 and 16 can be placed into engagement with the guide portion 24. The guide portion 24 is configured to direct the wheels 14 and 16 toward the bearing portion 26 so that the wheels 14 and 16 can travel along the bearing portion 26 and the toy train 10 can move along the track section 20. The track section 20 is coupled to other portions of a toy track so that the toy train 10 can travel along the track.

Figure 2:
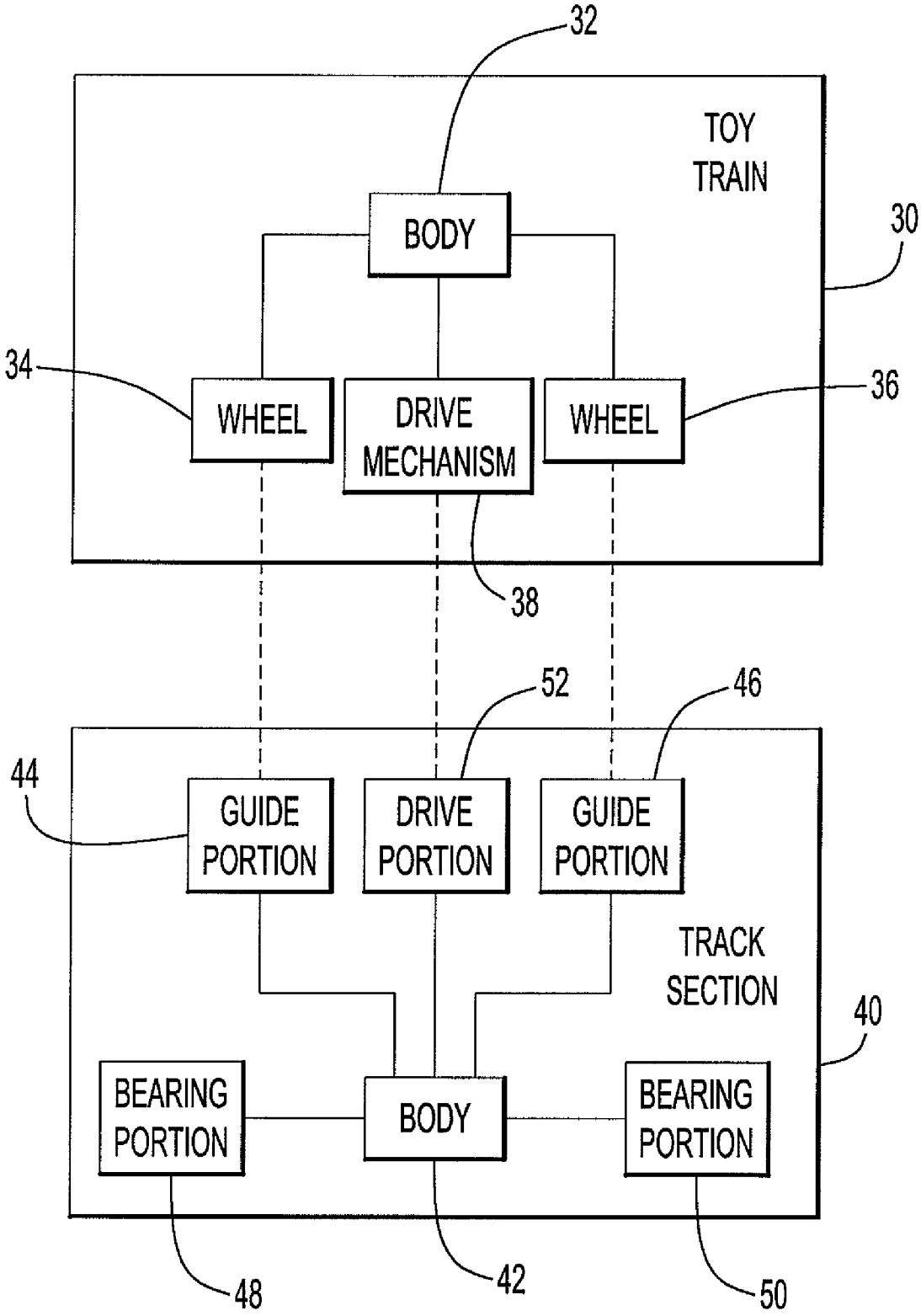
FIG. 2 illustrates a schematic block diagram of an alternative embodiment of a toy train and track section in accordance with an aspect of the present invention.

Referring to FIG. 2, an alternative embodiment of a toy train and a track section in accordance with the present invention is illustrated. In this embodiment, the toy train 30 includes a body 32 that has wheels 34 and 36 movably coupled thereto. Toy train 30 also includes a drive mechanism 38. In this embodiment, the drive mechanism 38 includes a motor (not shown), a power supply (not shown), and an engaging member. The engaging member can be a continuous track that is driven by the output of the motor. Alternatively, the engagement member can have one or more projections extending therefrom that is moved relative to the body of the toy train 30. For example, the drive mechanism may include a rotatably mounted wheel body that has one or more projections around its circumference that are configured to engage the track. In another implementation, a belt with one or more projections can be driven by the drive mechanism.

In this embodiment, the track section 40 includes a body 42 with guide portions 44 and 46 and bearing portions 48 and 50. The guide portions 44 and 46 are configured to be engaged by the wheels 34 and 36 and to direct the wheels 34 and 36 so that they move toward the bearing portions 48 and 50 of the track section 40. In addition, the body 42 can include a drive portion 52 that is configured to be engaged by the drive mechanism 38. In one embodiment, the drive portion 52 may be grooves or recesses that can be engaged by one or more projections of the drive mechanism 38. In another embodiment, the drive portion 52 may be a smooth surface that can be engaged by the drive mechanism 38. In yet another embodiment, the drive portion 52 may be several projections that can be engaged by the drive mechanism 38.

In different embodiments, the relative locations of the guide portions 44 and 46 and the bearing portions 48 and 50 can vary. In one embodiment, the guide portions 44 and 46 are disposed between the bearing portions 48 and 50. In another embodiment, the bearing portions 48 and 50 are disposed between the guide portions 44 and 46.

Figure 3:
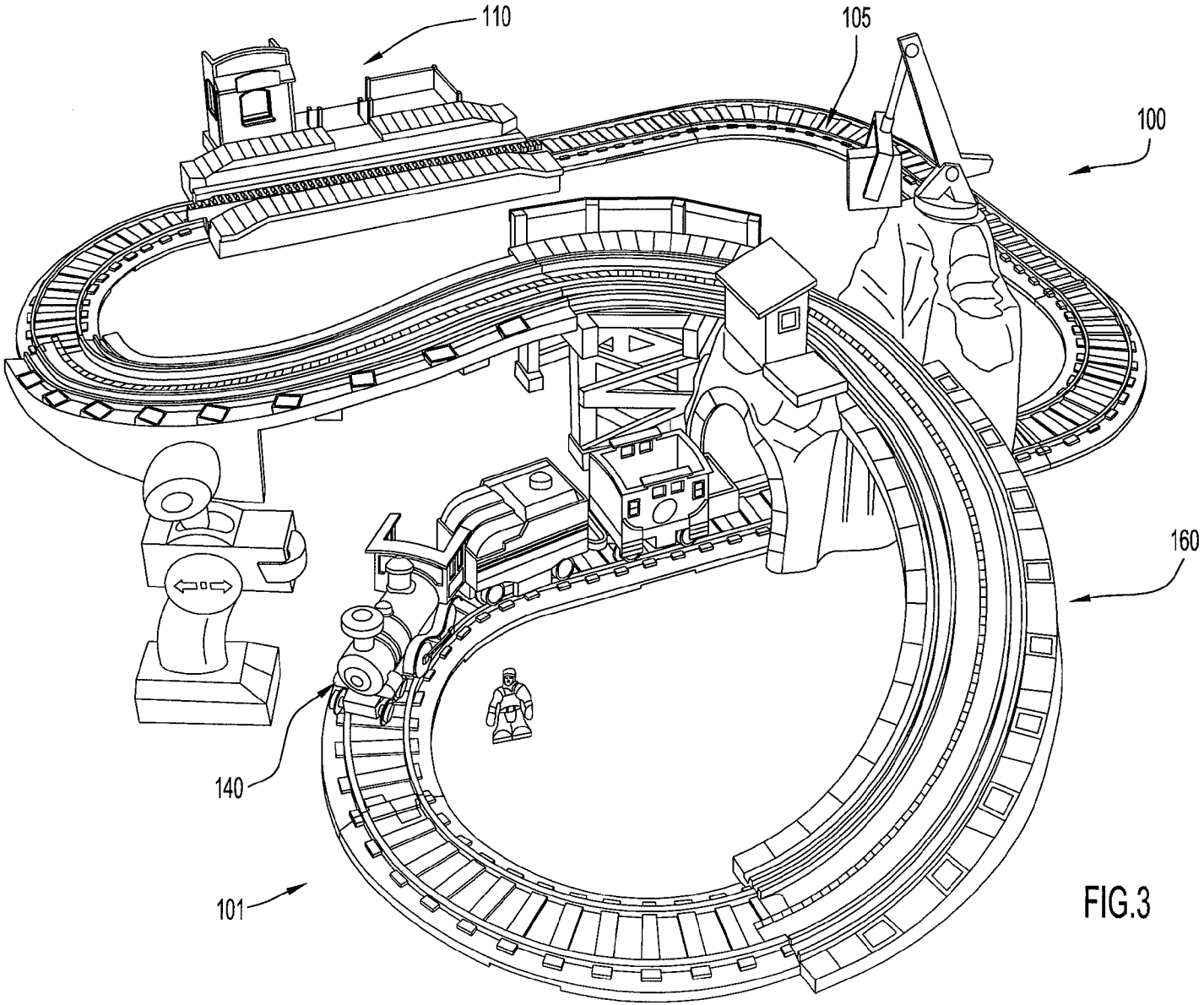
FIG. 3 illustrates a top perspective view of an embodiment of the toy train track system in accordance with an aspect of the present invention.

Referring to FIG. 3, an embodiment of a toy train track set in accordance with the present invention is illustrated. In this embodiment, the toy train track set 100 includes several components. In various embodiments, the quantity, size and configuration of the components that are used to form the toy train track set can vary. As shown in FIG. 3, the toy train track set 100 includes a toy train 140 and a track 160. While toy train 140 is illustrated as having three cars, the toy train 140 can have any quantity of cars in different embodiments. The track 160 is supported on a play surface 101. The track 160 includes multiple sections that are connected together at the ends of adjacent sections. In one embodiment, the different portions of the track 160 are formed out of molded plastic articles. The track 160 includes an alignment section 110 and a travel section 105. The travel section 105 is the remaining portion of track 160 (excluding alignment section 110) around which the train 140 travels.

Figure 4:
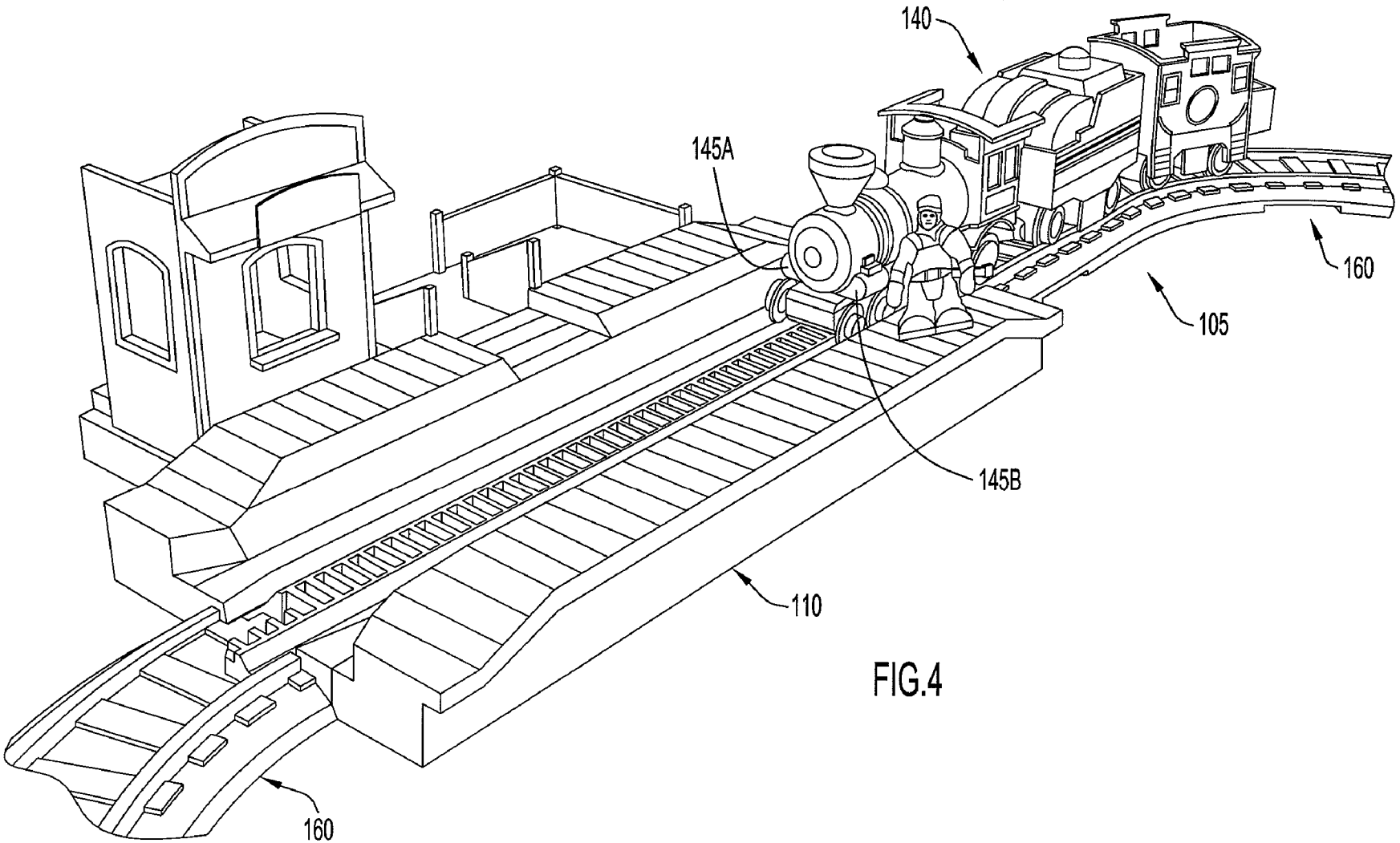
FIG. 4 illustrates a top perspective view of a train entering an alignment section of the track system illustrated in FIG. 3.

Referring to FIG. 4, the alignment section 110 and a toy train 140 are illustrated. The alignment section 110 can be referred to alternatively as the alignment portion as well. The toy train 140 is entering the alignment section 110 from the travel portion 105 of the track 160. Each car of the toy train 140 has multiple sets of wheels on which the train 140 moves. Each set of wheels includes two wheels (a front wheel set and a rear wheel set) that are connected by a transverse axle. Each wheel set includes a left wheel and a right wheel. In FIG. 4, wheels 145A and 145B are illustrated in contact with alignment section 110. Even though wheels 145A and 145B are discussed below, each set of wheels of toy train 140 function in a similar manner, and for ease of reference and discussion, only wheels 145A and 145B are discussed.

Figure 5:
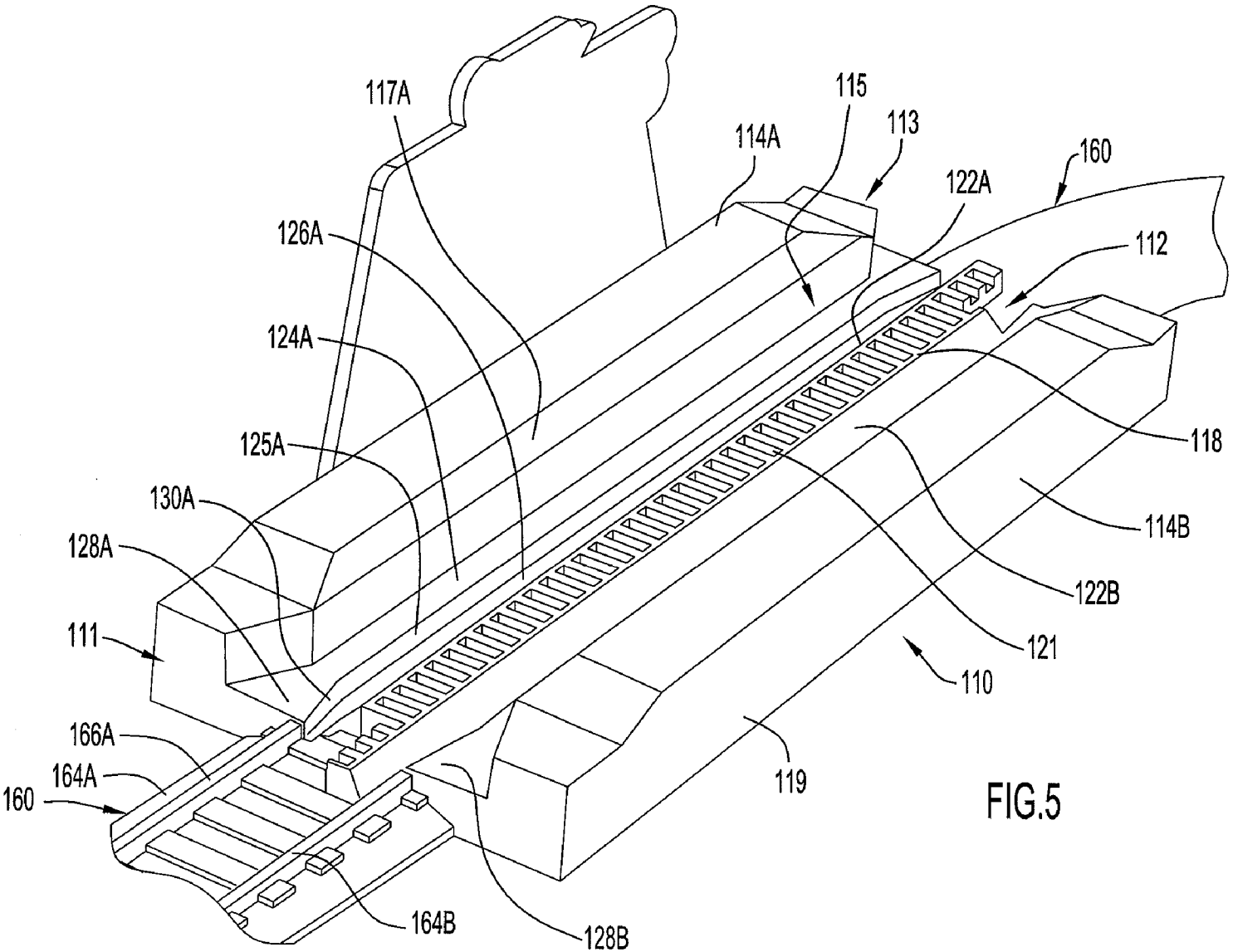
FIG. 5 illustrates a top perspective view of the alignment section illustrated in FIG. 4.
Figure 6:
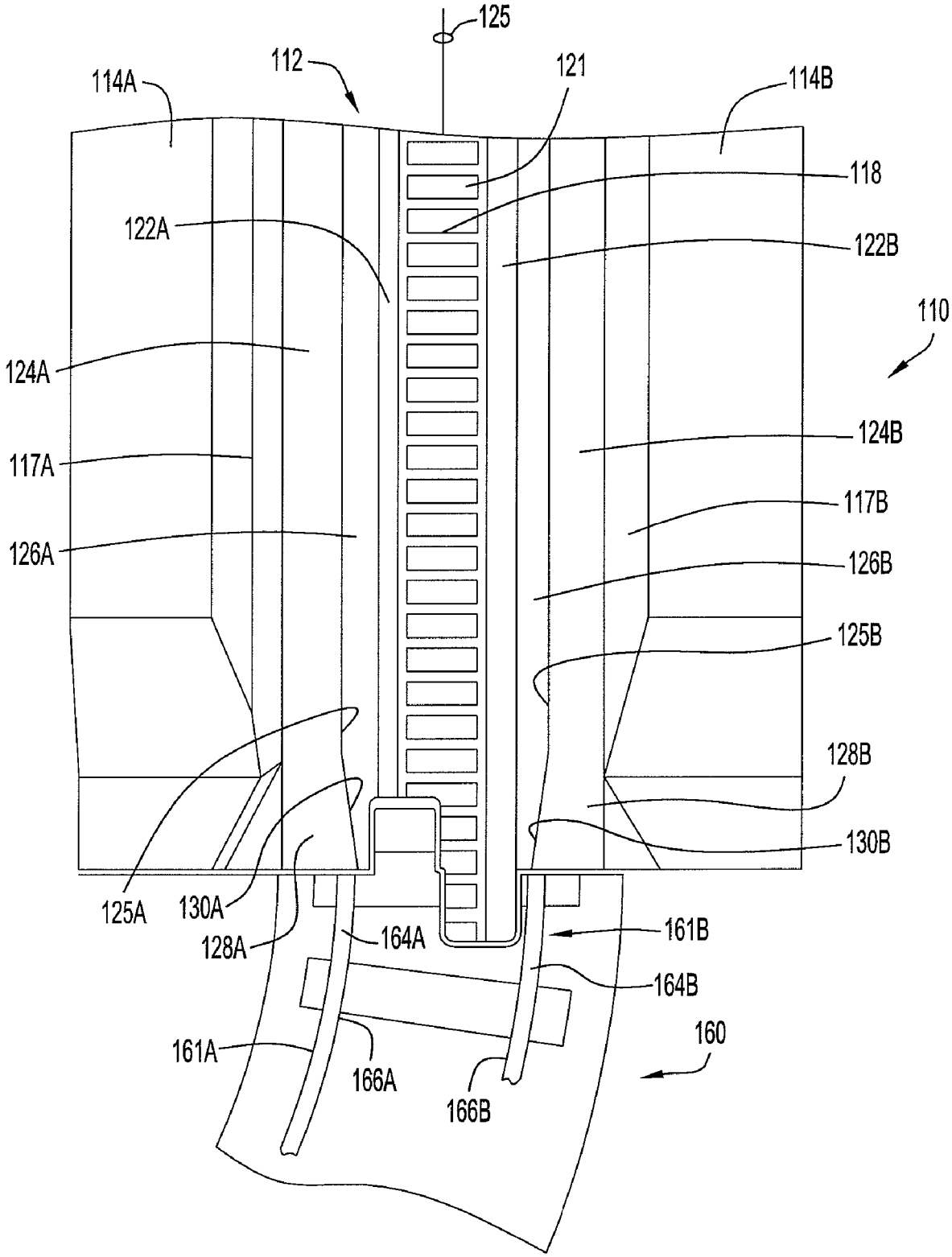
FIG. 6 illustrates a top perspective view of a portion of the track system illustrated in FIG. 4.
Figure 7A:
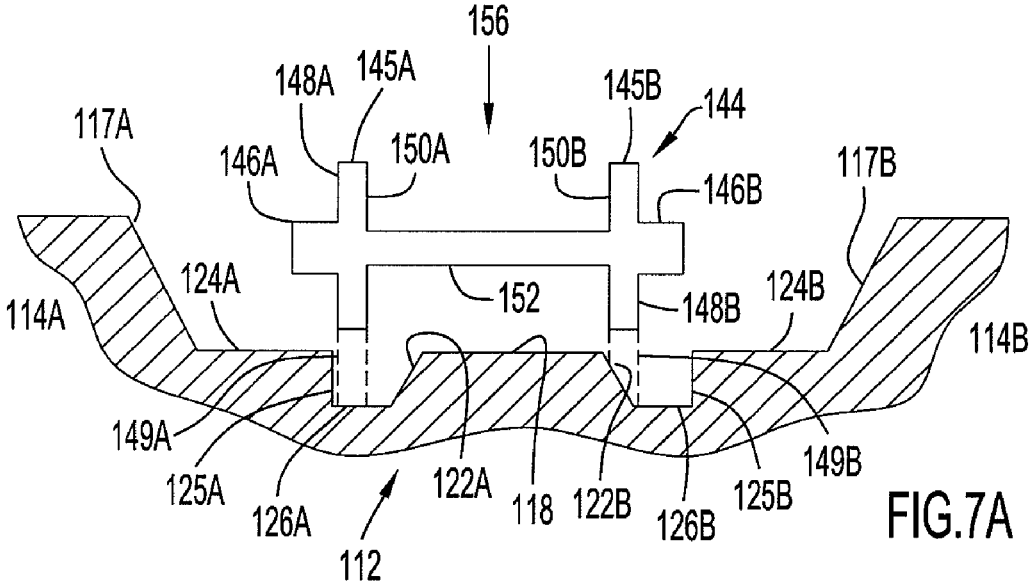
FIG. 7A illustrates an end view of an exemplary train wheel set separated from an alignment or guide section in accordance with an aspect of the present invention.

FIGS. 5, 6, and 7A show perspective, top, and end views of an embodiment of the alignment section 110, respectively. As shown in FIG. 5, the alignment section or alignment portion 110 includes a body 119 that has first and second side walls 114A and 114B that extend along the body 119. Side walls 114A and 114B are positioned longitudinally along opposite sides of alignment section 110 and extend from end 111 to end 113 of the alignment section 110. Alignment section 110 also includes a guide portion or section 112. Guide portion 112 is the part of the alignment section 110 that train 140 contacts as the train 140 travels on alignment section 110. In this embodiment, guide portion 112 is positioned along the longitudinal direction between side walls 114A and 114B.

In one embodiment, the top of side walls 114A and 114B extend above guide portion 112 and above the wheels of toy train 140 placed on the alignment section 110. The height of the side walls 114A and 114B limits the extent to which the train 140 can be misaligned by tilting or movement in a side-to-side direction. The side walls 114A and 114B form a receiving area or travel space 115 therebetween in which the toy train 140 can be placed and can travel. In particular, the side walls 114A and 114B include slanted inner wall surfaces 117A and 117B, which together with guide portion 112 form the travel space or receiving area 115. The inner wall surfaces 117A and 117B are slanted outwardly and upwardly, thereby providing the travel space 115 with a general V-shape to allow easy placement of the toy train 140 by a child. The inner wall surfaces 117A and 117B can have the same shape or configuration or have a different shape or configuration from each other.

As mentioned above, the wheels 145A and 145B of the toy train 140 engage the guide portion 112 of the alignment section 110. In one embodiment, each of wheels 145A and 145B includes surfaces that engage a portion of the track. These surfaces on the wheels 145A and 145B can be referred to as bearing surfaces and for each wheel, the bearing surface is located on the bottom of each wheel. Another such bearing surface is formed on an extension of the wheel along the direction of the axle.

In one embodiment, the guide portion 112 includes first and second wheel bearing surfaces 126A and 126B (see FIGS. 5-7A). The wheel bearing surfaces 126A and 126B can be referred to alternatively as bearing sections or bearing portions. Wheel bearing surfaces 126A and 126B are configured to be engaged by the lower edges of the wheels 145A and 145B and that bear at least a portion of the weight of the toy train 140. Wheel bearing surfaces 126A and 126B extend along the length of the alignment section 110 from end 111 to end 113. The width of the wheel bearing surfaces 126A and 126B can vary in different embodiments and can be any size provided that the wheels 145A and 145B can travel therealong. In one embodiment, the wheel bearing surfaces 126A and 126B are generally or substantially planar or horizontal surfaces. In another embodiment, the wheel bearing surfaces 126A and 126B can be uneven surfaces. In yet another embodiment, the wheel bearing surfaces 126A and 126B can be inclined or disposed at an angle relative to a support surface.

In this embodiment, the guide portion 112 also includes guide surfaces or sides 122A and 122B that extend from end 111 to end 113 (see FIG. 5). The guide surfaces 122A and 122B are disposed or oriented at an angle with respect to a horizontal support surface and the wheel being surfaces 126A and 126B. In other words, the guide surfaces 122A and 122B are inclined. The guide surfaces 122A and 122B slant or are angled downwardly toward the wheel bearing surfaces 126A and 126B of the alignment section 110. The particular angles at which the guide surfaces 122A and 122B are inclined can vary in different embodiments. The guide surfaces 122A and 122B can be steep in some embodiments and in other embodiments can be sloped gradually.

In one embodiment, the guide surfaces 122A and 122B are located between the wheel bearing surfaces 126A and 126B. In other words, the wheel bearing surfaces 126A and 126B are located on the outer sides of the guide surfaces 122A and 122B with respect to the longitudinal axis 125 of the alignment section 110. In addition, each of the wheel bearing surfaces 126A and 126B are located adjacent to one of the inclined guide surfaces 122A and 122B and form a substantially continuous surface with the particular inclined guide surface. The side walls 114A and 114B can extend upwardly from the wheel bearing surfaces 126A and 126B, respectively.

In this embodiment, the guide portion or section 112 also includes an engagement portion or surface 118. The engagement surface 118 is the part of the guide portion 112 that is engaged by a drive mechanism of the toy train 140. The engagement between the drive mechanism of the toy train 140 and the engagement portion 118 enables the drive mechanism to propel the toy train 140 along the alignment section 110. As shown in FIGS. 5 and 6, in this embodiment, the engagement surface 118 is formed as a raised surface with adjacent alternating grooves or recesses 121 formed therein. In this embodiment, the grooves 121 are located between and adjacent to the inclined guide surfaces 122A and 122B. In other embodiments, the engagement surface 118 can have a different structure for use with the drive mechanism, such as a different quantity or configuration of the grooves. Alternatively, the grooves 121 can be replaced by projections along the guide section 112. The upper surface of the engagement surface 118 is aligned with the upper ends of the inclined guide surfaces 122A and 122B. If the drive mechanism of train 140 is a toothed gear or component, the teeth of the drive mechanism can engage the grooves 121 of the engagement surface 118 to propel the toy train 140.

As illustrated in FIG. 6, the guide portion 112 also includes outer guide surfaces 125A and 125B. The outer guide surfaces 125A and 125B are substantially vertical and serve as outer positioning limits for the wheels 145A and 145B of the toy train 140. In this embodiment, the outer guide surfaces 125A and 125B are positioned on the outer edges of wheel bearing surfaces 126A and 126B and extend along the length of alignment section 110.

In addition, the guide portion 112 includes guide bearing surfaces 124A and 124B. As mentioned above, each of wheels 145A and 145B includes multiple bearing surfaces. A portion of each of the wheels 145A and 145B can engage the first and second guide bearing surfaces 124A and 124B. Along with wheel bearing surfaces 126A and 126B, guide bearing surfaces 124A and 124B bear the weight of the toy train 140. Each of the side walls 114A and 114B extends upwardly from one of the guide bearing surfaces 124A and 124B and has an inner surface. Each inner surface includes a portion of which that is slanted downwardly and inwardly to align the toy train 140 as it is placed on the track section 110. In one embodiment, the guide bearing surfaces 124A and 124B are generally or substantially planar or horizontal surfaces. In another embodiment, the guide bearing surfaces 146A and 146B can be uneven surfaces. In yet another embodiment, the guide bearing surfaces 146A and 146B can be inclined or disposed at an angle relative to a support surface.

Referring to FIGS. 5 and 6, proximate to each end of alignment section 110 are converging guides. As shown in FIG. 5, proximate to end 111 of the alignment section 110 are converging guides 128A and 128B. A top view of the converging guides 128A and 128B is illustrated in FIG. 6. It is to be understood that similarly structured converging guides are proximate to end 113 of the alignment section 110. The converging guides 128A and 128B include inwardly slanted surfaces or portions 130A and 130B, respectively, which are extensions of outer guide surfaces 125A and 125B. As shown, the converging guide surfaces 130A and 130B are directed slightly inwardly toward each other. The distance between converging guide surface 130A and converging guide surface 130B varies and is less than the distance between outer guide surface 125A and outer guide surface 125B. In particular, the distance or transverse distance between the outer guide surfaces 125A and 125B proximate to a center of the alignment section 110 is greater than the distance or transverse distance between the guide surfaces 130A and 130B proximate to either end 111 or 113 of the alignment section 110.

Converging guides 128A and 128B align the wheels 145A and 145B of the toy train 140 with the track 160 to ensure that the toy train 140 is accurately transferred from the alignment section 110 to remainder of the track 160. As shown in FIG. 6, track 160 includes track guides 161A and 161B. The track guides 161A and 161B include track bearing surfaces 164A and 164B and inner track surfaces 166A and 166B, respectively. The track 160 can be a molded plastic article that is configured to resemble the rails of a track. The bearing guide surfaces 124A and 124B of the alignment section 110 align and transfer the wheels of the toy train 140 to the track bearing surfaces 164A and 164B via the converging guides 128A and 128B. After the transfer, track bearing surfaces 164A and 164B assume the weight bearing function that bearing guide surfaces 124A and 124B were performing. In addition, outer guide surfaces 125A and 125B direct the wheels 145A and 145B to inner track surfaces 166A and 166B. Thus, inner track surfaces 166A and 166B assume the wheel guiding functions that the outer guide surfaces 125A and 125B were performing.

Figure 7B:
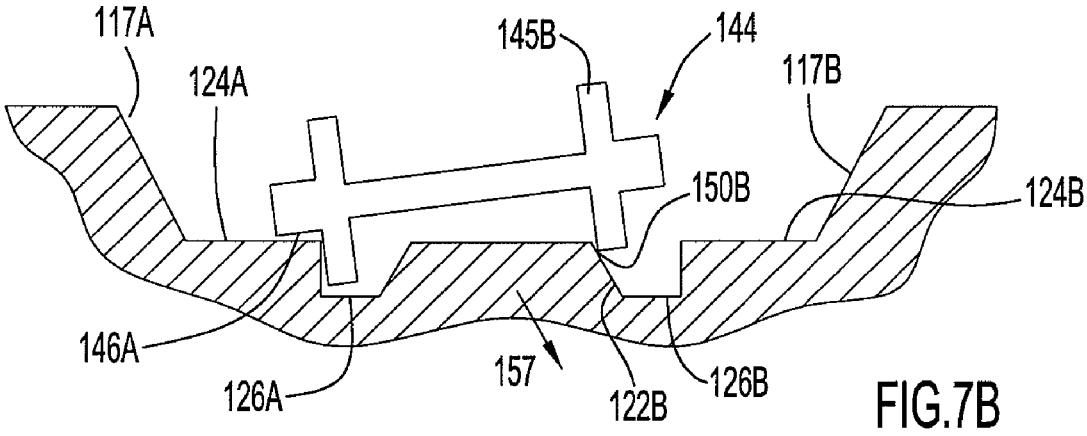
FIGS. 7B and 7C illustrate end views of the train wheel set illustrated in FIG. 7A in engagement and in alignment with the alignment section, respectively.
Figure 7C:
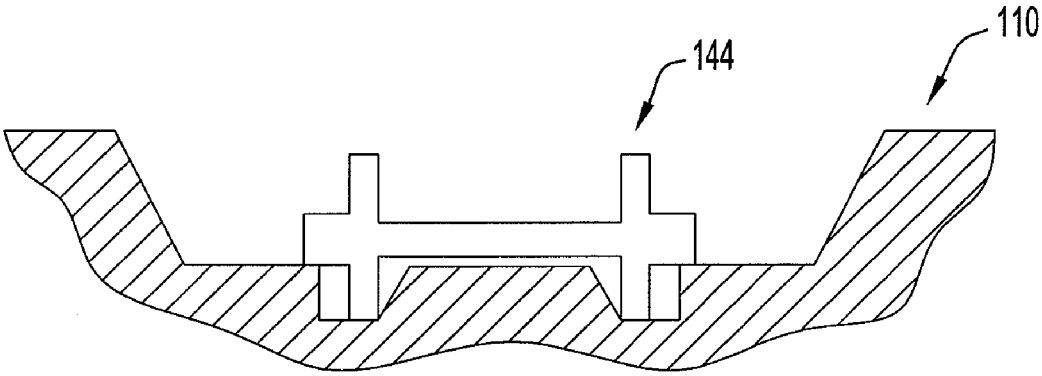

The alignment feature of the present invention is illustrated in FIGS. 7A-7C, which show end views of a pair of wheels 145A and 145B and the alignment section 110. In FIG. 7A, wheels 145A and 145B are illustrated as moving into engagement with the guide portion 112 of the alignment section 110. While only wheels 145A and 145B are illustrated, it is to be understood that any of the sets of wheels for a toy train or the cars of a toy train function and can be moved in a similar manner.

The wheel set 144 is first positioned over the guide portion 112 of the alignment section 110. The wheel set 144 has two wheels 145A and 145B that are connected by an axle 152. The wheels 145A and 145B include wheel bearing surfaces 146A and 146B, outer wall bearing surfaces 148A and 148B, and inner wheel guide surfaces 150A and 150B. The alignment of toy train 140 on guide section 112 is illustrated with respect to wheel set 144 for ease of reference. However, it is to be understood that wheel set 144 is coupled to the body of a toy train 140 connected thereto.

FIG. 7A shows the wheel set 144 disposed in a misaligned/non-centered position over the guide portion 112. Lines 149A and 149B show the locations at which the wheels 145A and 145B would contact the inclined guide surfaces 122A and 122B and the wheel bearing surfaces 126A and 126B if wheel set 144 were lowered along the direction of arrow 156.

FIG. 7B shows a position of the wheel set 144 based on the positioning of the wheel set 144 along the lines 149A and 149B in FIG. 7A. In this position, the inner wheel guide surface or edge 150B contacts inclined guide surface 122B and wheel bearing surface or edge 146A contacts guide bearing surface 124A. As wheel 145B is not securely positioned on inclined guide surface 122B, the weight and motion of the toy train 140 will cause the wheel 145B to slide or move along the guide surface 122B along the direction of arrow 157. In the position illustrated in FIG. 7B, the weight and/or motion of the toy train 140 directs wheel 145B outwardly and downwardly until wheel 145B contacts wheel bearing surface 126B. During this downward and outward motion of wheel 145B, the portions of wheel 145A that are in contact with guide portion 112 slide until the wheel set 144 is located in the manner shown in FIG. 7C in engagement with wheel bearing surface 126A.

Lowering the wheel set 144 onto the guide portion 112 so that wall bearings surfaces 148A and 148B are between outer guide surfaces 125A and 125B creates an unstable positioning of the wheel set 144 unless the wheel set 144 is properly aligned. If the wheel set 144 is not aligned, incline guide surfaces 122A and 122B are configured to guide the wheel set 144 to the stable position illustrated in FIG. 7C. Therefore, the configuration of the guide portion 112 ensures that as long as outer wall bearing surfaces 148A and 148B on the wheels 145A and 145B are lowered onto guide portion 112 within the inner bounds of outer guide surfaces 125A and 125B, the final position of wheel set 144 will be the aligned position shown in FIG. 7C. This range of acceptable placement positions relaxes the previous rigid requirement on children to more precisely position trains during realignment.

Figure 7D:
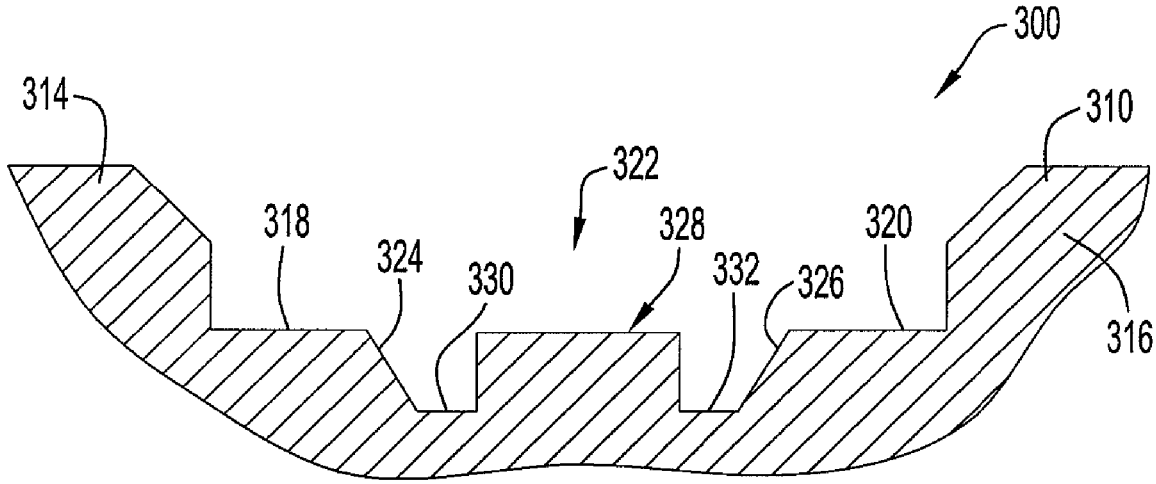
FIG. 7D illustrates an end view of an alternative embodiment of an alignment section in accordance with an aspect of the present invention.

Referring to FIG. 7D, an end view of an alternative embodiment of an alignment section of track in accordance with the present invention is illustrated. In this embodiment, the track section 300 includes a body 310 with an upper surface 312 and side walls 314 and 316. The body 310 includes guide bearing surfaces 318 and 320 that are configured to be engaged by portions or extensions on the wheels 145A and 145B of a toy train 140. The alignment section 300 includes a guide portion 322 that is configured to align a toy train 140 that is placed on the section 300. The guide portion 322 includes inclined guide surfaces 324 and 326 and wheel bearing surfaces 330 and 332. In this embodiment, the inclined guide surfaces 324 and 326 are disposed on the outer sides of the wheel bearing surfaces 330 and 332. The guide surfaces 324 and 326 are configured to direct the wheels 145A and 145B of a toy train 140 placed on track section 300 into engagement with the wheel bearing surfaces 330 and 332. The alignment section 300 also includes a drive portion 328 that is configured to be engaged with a drive mechanism of the toy train 140.

Figure 8:
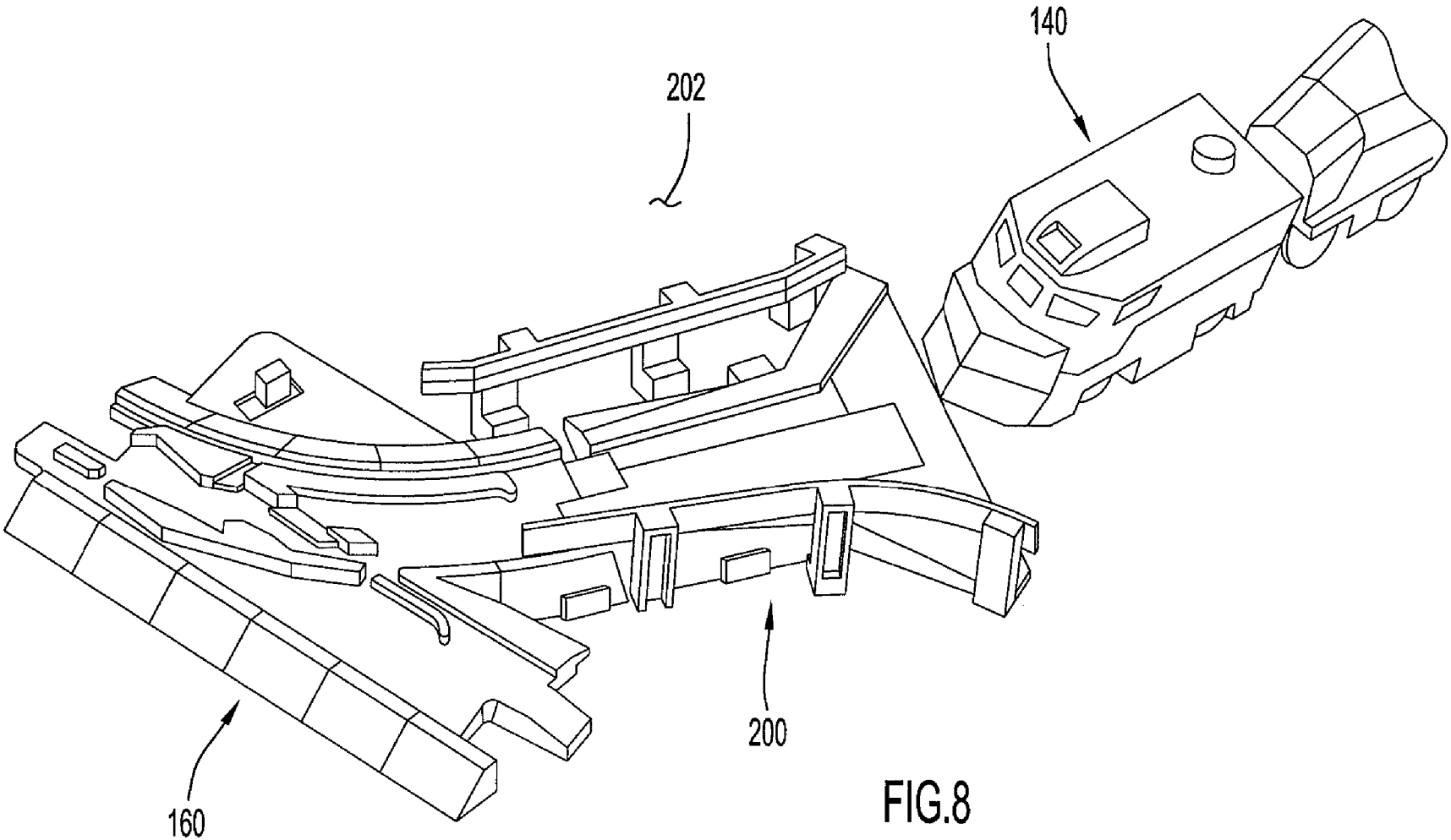
FIG. 8 illustrates a perspective view of an embodiment of an entry track section that can be used with the track system illustrated in FIG. 3.

FIG. 8 illustrates an embodiment of a section of track and entry section in accordance with an aspect of the present invention. As shown, the track section 160 is connected to an entry section 200 that is configured to allow a toy train 140 to travel along a play surface 202, such a floor or carpet, and onto entry section 200. Once the toy train 140 is on the entry section 200, it travels from the entry section 200 in an aligned manner onto the track section 160.

Figure 9:
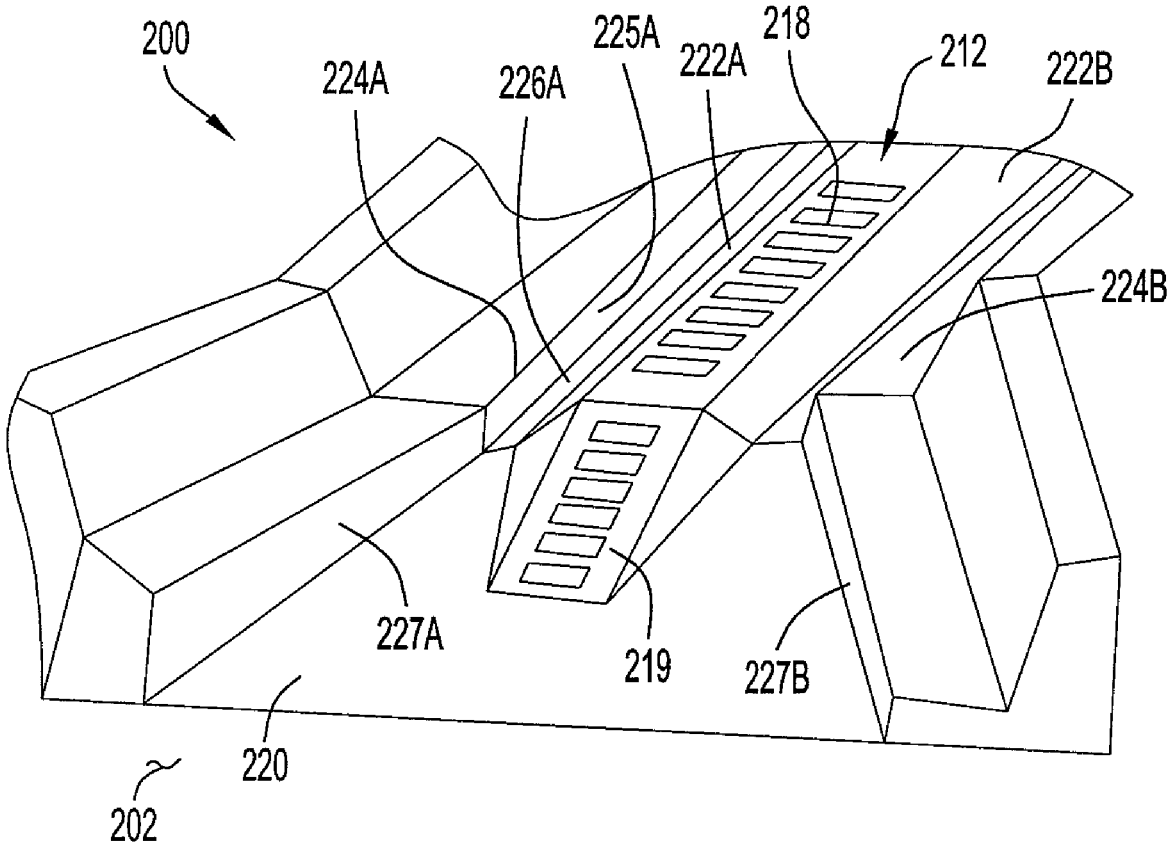
FIG. 9 illustrates an enlarged perspective view of the entry section illustrated in FIG. 8.

Referring to FIG. 9, the entry section 200 includes a ramp 220 designed to smoothly accept transfer of wheels of a toy vehicle or train from the play surface 202. The toy train 140 travels from play surface 202 onto the ramp 220 between ramp guide surfaces 227A and 227B. The ramp guide surfaces 227A and 227B are directed so as to converge toward each other to funnel or direct the toy train 140 toward the guide portion 212 of the ramp 220.

In one embodiment, the guide portion 212 can include several features that correspond to features of the guide portion 112 of the alignment section 110. In this embodiment, the engagement surface or portion 218, the inclined guide surfaces 222A and 222B, the guide bearing surfaces 224A and 224B, the outer guide surfaces (only surface 225A being shown), and the wheel bearing surfaces (only surface 226A being shown) correspond to the corresponding structures discussed above for the alignment section 110.

In this embodiment, the guide portion 212 includes an inclined engagement surface 219. Inclined engagement surface 219 is positioned on the ramp 220 adjacent to and aligned with the engagement surface 218. The engagement surface 219 is inclined to accommodate the drive mechanism of toy train 140 as the ramp guide surfaces 227A and 227B guide and direct the toy train 140 toward guide portion 212.

Figure 10:
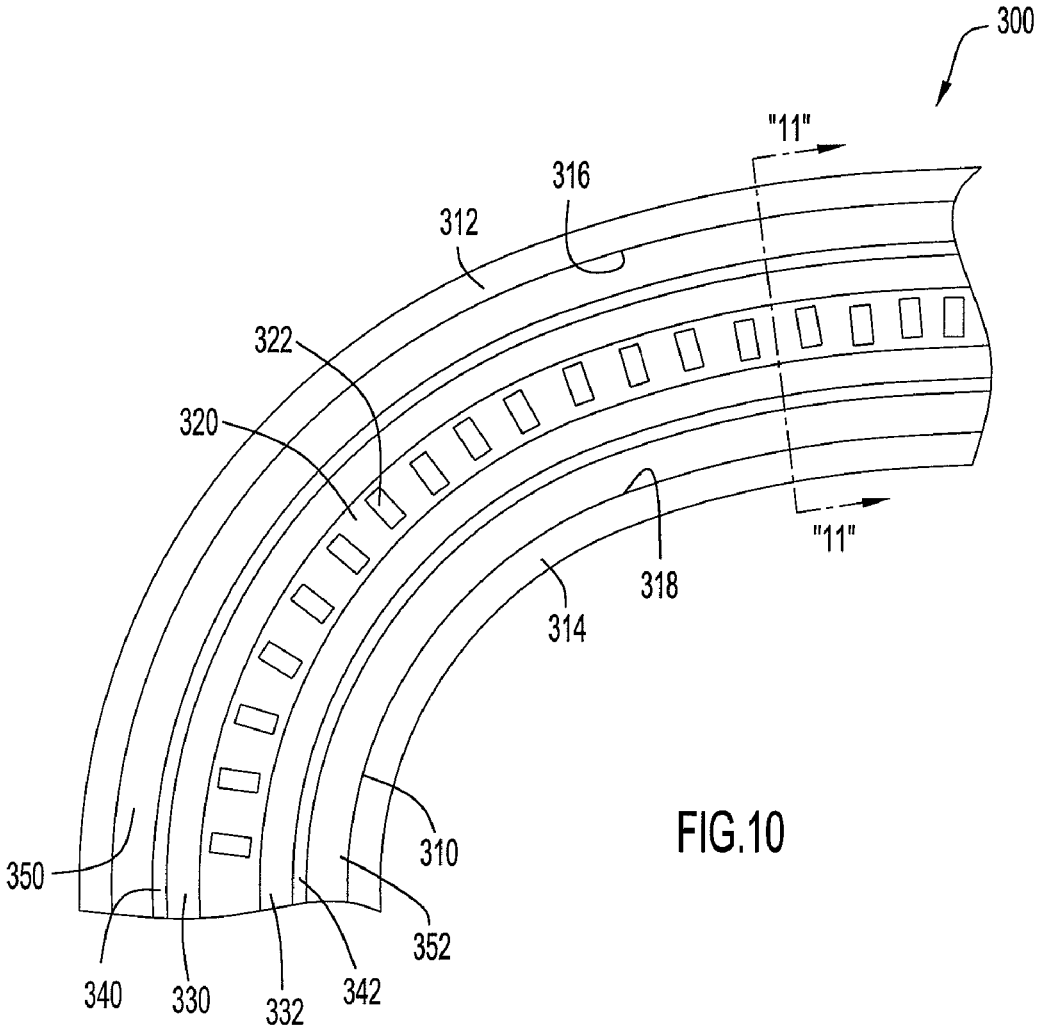
FIG. 10 illustrates a top view of an alternative embodiment of a track section in accordance with the present invention.
Figure 11:
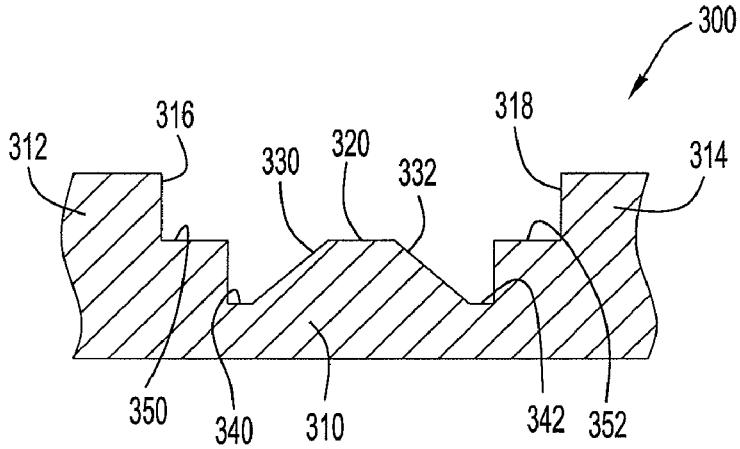
FIG. 11 illustrates a cross-sectional view of the track section illustrated in FIG. 10 taken along the line "11-11."

Referring to FIGS. 10 and 11, an alternative embodiment of a track section in accordance with the present invention is illustrated. In this embodiment, the track section 300 has a curved shape or configuration. The track section 300 may include a body 310 with an engagement surface or portion 320 with spaced apart recesses or grooves 322 therealong. The track section 300 includes a guide portion that is formed by guide surfaces 330 and 332 which angled toward bearing surfaces 340 and 342 as shown in FIG. 11. The bearing surfaces 340 and 342 are configured so that wheels of a toy vehicle placed on the track section 300 can move therealong. Side bearing surfaces 350 and 352 are disposed on the outer sides of bearing surfaces 340 and 342. The body 310 can include side walls or side wall portions 312 and 314 that have inner surfaces 316 and 318, respectively. The inner surfaces 316 and 318 are oriented to face inwardly toward the guides surfaces 330 and 332. In an alternative embodiment, the track section 300 may have multiple curves and be in the shape of a letter "S."

Figure 12:
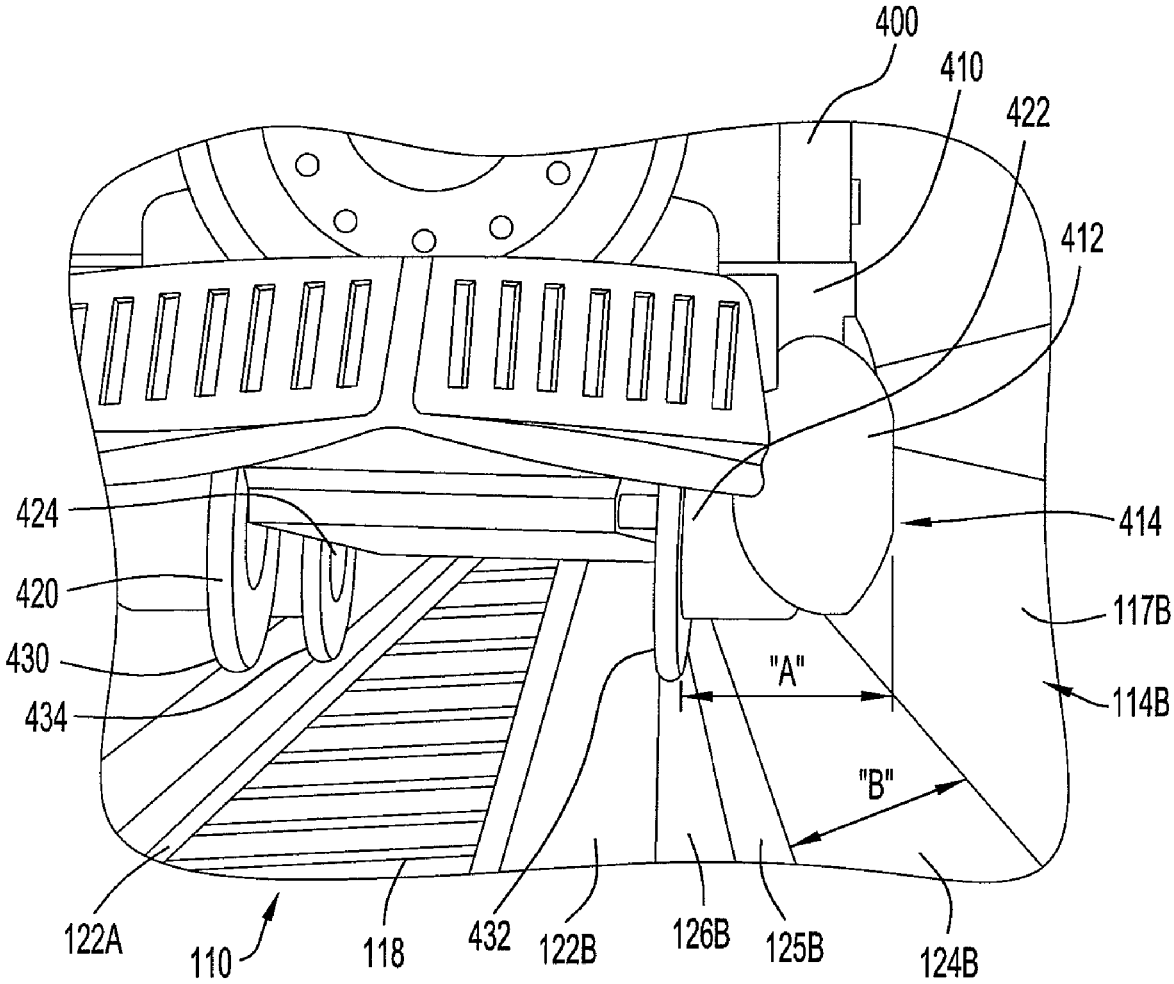
FIG. 12 illustrates a perspective view of a toy vehicle being placed on a track section in accordance with the present invention.

Referring to FIG. 12, the relative positioning of a toy vehicle on a track section is illustrated. As shown, in this embodiment, the toy vehicle 400 has the configuration of a toy train. The toy vehicle 400 has a body 410 with side portions that have outer surfaces (only side portion 412 with side surface 414 is illustrated for ease of reference). Movably coupled to the body 410 are several wheels, each of which includes a flange or flange portion. As shown in FIG. 12, front wheels 420 and 422, and rear wheel 424 include flanges or flange portions 430, 432, and 434, respectively.

As shown in FIG. 12, the track section 110 may include an engagement surface 118 with guides surfaces 122A and 122B. As the track section 110 has been described previously, only some of the components are illustrated in FIG. 12 and discussed relative thereto. In particular, track section 110 has a guide bearing surface 124B, an outer guide surface 125B, a wheel bearing surface 126B, and an inner wall surface 117B that is formed on the side wall 114B.

As shown in FIG. 12, the inner wall surface 117B is used to position the toy vehicle 400 so that the wheel flanges, such as flange 432, do not rest on top of the guide bearing surfaces, such as guide bearing surface 124B. The body 410 of the toy vehicle 400 actually contacts the side wall 114B and in particular, the inner wall surface 117B.

The distance or dimension "A" in FIG. 12 is the distance between the outer side surface 414 of the vehicle body 410 and the outside of wheel flange 432. As shown, the distance or dimension "A" is greater than the width dimension "B" of the guide bearing surface 124B. The larger dimension "A" prevents the wheel flange 432 from being placed on the guide bearing surface 124B, which otherwise would result in the wheel flange not engaging the particular guide surfaces 122A and 122B and the toy vehicle 400 not being aligned on the track section 110. The dimensions "A" and "B" can vary in different embodiments so long as dimension "A" is greater than dimension "B." While dimensions "A" and "B" are illustrated in FIG. 12 relative to one side of the body 410, the engagement of an outer surface of the vehicle body 410 against surface 117A of side wall 114A on the other side of the vehicle 400 and the track section 110 is the same.

In alternative embodiments, a different type of vehicle, such as a plane, boat, car, or spacecraft, can be used in place of the toy train 140. In other embodiments, multiple parts may be integrated (e.g., inclined guide surface 122 may be integrated with engagement surface 118 by creating slots/teeth in inclined guide surface 122). Furthermore, in other embodiments, the alignment section 110 may function without an engagement surface or portion.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. A track section for use with a toy train, the toy train including a first wheel, a second wheel, and a drive mechanism, the track section comprising:

a first wheel bearing surface, the first wheel bearing surface being configured to be engaged by the first wheel of the train;

a second wheel bearing surface, the second wheel bearing surface being configured to be engaged by the second wheel of the train, a first guide surface, the first guide surface being located between the first wheel bearing surface and the second wheel bearing surface;

a second guide surface, the second guide surface being located between the first wheel bearing surface and the second wheel bearing surface, and an engagement surface, the engagement surface being configured to be engaged by the drive mechanism of the train, the engagement surface being located between the first guide surface and the second guide surface, the first guide surface directing the first wheel of the train into engagement with the first wheel bearing surface and the second guide surface directing the second wheel of the train into engagement with the second wheel bearing surface as the train moves along the track section.

2. The track section of claim 1, wherein the first guide surface and the second guide surface maintain the first wheel and second wheel of the train in alignment as the train moves along the track section.

3. The track section of claim 1, wherein the first and second guide surfaces are inclined.

4. The track section of claim 1, wherein the first and second wheel bearing surfaces are substantially horizontal.

5. The track section of claim 1, wherein the engagement surface includes teeth that are engageable with the drive mechanism of the train.

6. The track section of claim 1, further comprising:

a first outer guide surface; and a second outer guide surface, wherein a transverse distance between the first outer guide surface and the second outer guide surface proximate to a center of the track section is larger than a transverse distance between the first outer guide surface and the second outer guide surface proximate to a first end of the track section.

7. The track section of claim 1, further comprising:

a first side wall; and a second side wall, the first side wall and the second side wall defining a receiving area therebetween, the train being placeable in the receiving area during positioning of the train on the track section.

8. The track section of claim 7, wherein the first side wall extends upwardly from the first wheel bearing surface and includes a first side wall inner surface, and the second side wall extends upwardly from the second wheel bearing surface and includes a second side wall inner surface.

9. The track section of claim 8, wherein each of the inner surfaces of the first and second side walls is slanted downwardly and inwardly to align the train as the train is placed on the track section.

10. The track section of claim 1, wherein the engagement surface of the track section is engaged by the drive mechanism of the train while the train wheels engage the wheel bearing surfaces.

11. The track section of claim 1, wherein the drive mechanism further includes an engaging member that interacts with the engagement surface to drive the vehicle along the track section.

12. The track section of claim 11, wherein:

the engagement surface comprises a plurality of recesses formed therein; and the engaging member comprises a projection that is received by at least one of the plurality of recesses.

13. A method of aligning a toy train on a section of a track of a toy train set, the toy train including a drive mechanism, a first wheel and a second wheel, the track section including a first inclined guide surface, a second inclined guide surface, a first wheel surface, a second wheel surface, and an engagement surface disposed between the first and second wheel surfaces, the method comprising the steps of:

engaging the first wheel and with the first inclined guide surface;

engaging the second wheel with the second wheel surface;

engaging the drive mechanism of train with the engagement surface; and moving the toy train along the track section so that the first wheel moves along the first inclined guide surface and aligns with the first wheel surface.

14. The method of claim 13 further comprising:

engaging the drive mechanism with the engagement surface of the track section when the first wheel engages the first wheel surface and the second wheel engages the second wheel surface.

15. The method of claim 14, wherein the moving the toy train allows the first guide surface to align the toy train so that the drive mechanism engages the engagement surface of the track section.

16. A toy train system comprising:

a toy train, the toy train including a drive mechanism, a body, a first wheel movably coupled to the body, and a second wheel movably coupled to the body;

a track, the track being configured to operably receive the toy train, the track including a travel portion and an alignment portion, the alignment portion including:

a first end;

a second end opposite the first end;

a first bearing surface, the first bearing surface being substantially planar, the first bearing surface being configured to allow the first wheel to move therealong as the toy train moves along the alignment portion, the first bearing surface extending from the first end of the track to the second end of the track; and a first guide surface, the first guide surface being disposed proximate to the first bearing surface, the first guide surface being inclined relative to the first bearing surface, the first guide surface extending from the first end of the track to the second end of the track, the first bearing surface being disposed on an outer side of the first guide surface with respect to a longitudinal axis of the alignment portion, the first guide surface directing the first wheel of the toy train to the first bearing surface so that the toy train is aligned on the alignment section as the train moves therealong;

a second bearing surface and a second guide surface, each of the second bearing surface and the second guide surface extending from the first end of the track to the second end of the track; and an engagement surface configured to be engaged by the drive mechanism of the toy train, wherein the engagement surface is located between the first guide surface and the second guide surface.

17. The toy train system of claim 16, wherein each of the first guide surface and the second guide surface is inclined.

18. An alignment track section for use with a toy train, the toy train including a body, a first wheel coupled to the body, a second wheel coupled to the body, and a drive mechanism, the alignment track section comprising:

a bearing portion, the bearing portion including a first bearing section and a second bearing section, the first bearing section being substantially horizontal and configured to be engaged by the first wheel, the second bearing section being substantially horizontal and configured to be engaged by the second wheel;

a guide portion, the guide portion including a first side and a second side, the first side being disposed at an angle relative to the first bearing section, the second side being disposed at an angle relative to the second bearing section, the guide portion being disposed between the first bearing section and the second bearing section; and a drive portion, the drive portion being configured to be engaged by the drive mechanism of the train when the train is aligned on the track section, the drive portion being proximate to the guide portion.

19. The alignment track section of claim 18, wherein the drive portion is disposed between the first side of the guide portion and the second side of the guide portion.

20. The alignment track section of claim 18, wherein the first bearing section forms a substantially continuous surface with the first bearing section, and the second bearing section forms a substantially continuous surface with the second bearing section.

21. The alignment track section of claim 18, wherein the first side of the guide portion is inclined relative to the first bearing section, and the second side of the guide portion is inclined relative to the second bearing section.

* * * * *